US007606380B2

(12) United States Patent
Melanson

(10) Patent No.: US 7,606,380 B2
(45) Date of Patent: Oct. 20, 2009

(54) METHOD AND SYSTEM FOR SOUND BEAM-FORMING USING INTERNAL DEVICE SPEAKERS IN CONJUNCTION WITH EXTERNAL SPEAKERS

(75) Inventor: John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 428 days.

(21) Appl. No.: 11/380,840

(22) Filed: Apr. 28, 2006

(65) Prior Publication Data

US 2007/0253583 A1 Nov. 1, 2007

(51) Int. Cl.
*H04R 5/02* (2006.01)

(52) U.S. Cl. ..... 381/300; 381/306; 381/307

(58) Field of Classification Search ..... 381/306, 381/307, 300, 89, 333, 97
See application file for complete search history.

(56) References Cited

U.S. PATENT DOCUMENTS 4,039,755 A * 8/1977 Berkovitz ..... 381/63
5,005,201 A * 4/1991 Rumreich et al. ..... 381/306
5,301,237 A 4/1994 Fosgate
5,598,480 A 1/1997 Kim
5,680,464 A 10/1997 Iwamatsu
5,809,150 A * 9/1998 Eberbach ..... 381/300
5,870,484 A * 2/1999 Greenberger ..... 381/300
6,057,659 A 5/2000 Akiyama et al.
6,373,955 B1 4/2002 Hooley
6,498,852 B2 12/2002 Grimani
6,665,409 B1 12/2003 Rao
6,778,672 B2 8/2004 Breed
6,937,737 B2 8/2005 Polk
7,123,731 B2 10/2006 Cohen et al.
7,382,885 B1 6/2008 Kim et al.
2001/0038702 A1 11/2001 Lavoie et al.
2004/0013271 A1 1/2004 Moorthy
2004/0151325 A1 8/2004 Hooley et al.
2004/0196405 A1* 10/2004 Spinelli ..... 348/565

(Continued)

OTHER PUBLICATIONS

Murray, John, "Understanding Line Array Systems", Live Sound International, prosoundweb.com, 2006.

(Continued)

*Primary Examiner*—Vivian Chin
*Assistant Examiner*—Douglas J Suthers
(74) *Attorney, Agent, or Firm*—Andrew M. Harris; Mitch Harris, Atty at Law, LLC

(57) ABSTRACT

A method and system for sound beam-forming using internal device speakers in conjunction with external speakers provides a low cost alternative to present external surround array systems. A processing circuit within an audio device or audio/visual (AV) device such as a digital television (DTV) generates signals for internal and external speakers that phase-align the internal speakers with the external speakers for beam-forming. The beam may be a surround beam directed away from a listening position so that surround channel information is only heard as reflections. Alternatively, the beam may be a "night mode" beam that concentrates sound at a particular location or multiple beams may be formed for picture-in-picture or other applications where it is desirable to provide multiple isolated listening locations.

24 Claims, 10 Drawing Sheets

U.S. PATENT DOCUMENTS

| | | | |
|---|---|---|---|
| 2005/0041530 | A1 | 2/2005 | Goudie et al. |
| 2005/0175194 | A1 | 8/2005 | Anderson |
| 2005/0177256 | A1 | 8/2005 | Shintani et al. |
| 2005/0226425 | A1 | 10/2005 | Polk |
| 2006/0049889 | A1 | 3/2006 | Hooley |
| 2007/0183608 | A1 | 8/2007 | Willems |

OTHER PUBLICATIONS

Polk, Matthew S. "SDA Surround Technology White Paper", Polk Audio, Nov. 2005.

Product Brochure, Yamaha YSP-1 Digital Sound Projector, 2005.

Product Brochure, Yamaha YSP-1000 Digital Sound Projector, 2005.

* cited by examiner

METHOD AND SYSTEM FOR SOUND BEAM-FORMING USING INTERNAL DEVICE SPEAKERS IN CONJUNCTION WITH EXTERNAL SPEAKERS

BACKGROUND OF THE INVENTION

1. Field of the Invention

The present invention relates generally to home entertainment devices, and more specifically, to techniques for using the internal speakers of an audio or audio/video (A/V) device as part of a sound beam-forming system.

2. Background of the Invention

Audio systems in home entertainment systems have evolved along with theatre audio systems to include multi-speaker surround sound capabilities. Only recently have discrete surround signals been available from sources in home entertainment systems and further only recently have encoded sources reached a sufficient level of home use for consumers to justify installation of the requisite equipment. With the development of Digital Versatile Disc (DVD) technology that provides surround audio source information for movies or surround-encoded music, and sophisticated computer games that provide surround audio, surround speaker installation in home environments has become more desirable and frequent. With the recent availability of digital television (DTV) signals, which can include surround audio signals as part of their audio-visual (A/V) information, increasing sales of televisions and/or DTV sets including surround channel outputs are expected. The surround signals may be encoded in a pair of stereo signals, such as early DBX or as in more recent Dolby or THX surround encoding, or may constitute a fully separate audio channel for each speaker, often referred to as discrete encoding.

In most consumer surround audio systems, an amplifier unit, which may be included in an AV receiver or in a television, provides signals to multiple sets of speakers, commonly in what is referred to as a 5.1, 6.1 or 7.1 arrangement. The 5.1 arrangement includes right, center and left main speakers located in the front of the room, and a right-left pair of surround speakers located in the rear of the room for providing an aural environment in which sounds can be psychoacoustically located such that they emanate from any horizontal direction. The "0.1" suffix indicates that an additional subwoofer is provided for providing low frequency sounds that are typically not sensed as emanating from a particular direction. The 6.1 configuration adds a center channel speaker in the surround speaker set and in a 7.1 configuration, an additional pair of speakers is included over the 5.1 configuration and located even farther back in the room from the surround channel speakers.

However, proper installation of surround channel speakers can be costly and undesirable in many home environments. Wiring must be added and locations with unobstructed paths to the listening area must be available. Since the surround channel audio sources are generated for a particular location of the speakers, they cannot be simply placed at any location in the room and still function properly. It is desirable to position the surround speakers in such a way that the surround sound is diffuse, often limiting possible locations for speaker placement. The term "diffuse" indicates that the sound does not appear to emanate from a single direction, which is generally provided via reflections from or more surfaces that cause the sound to be reflected toward the user from multiple angles.

There are essentially two types of surround sound implementations for handling the additional surround channel information: simulated surround and actual surround. In actual surround sound implementations, surround channel signals are provided to speakers placed behind the listener. In simulated surround implementations, the surround channel signal is provided to speakers placed in front of the listener.

Simulated surround sound implementations typically use filtering and/or delays to alter mono or stereo audio signals to provide outputs for additional front speakers to generate the surround field. U.S. Pat. No. 6,937,737 describes a simulated surround sound system that provides the right and left surround channel information to each side (right and left) of an additional stereo speaker pair as well as to each side of the main stereo speaker pair. The frequency response of the system is controlled to cause the apparent position of the surround channel information to appear wider than the speaker position. However, such systems do not provide surround sound performance approaching that of actual surround sound implementations.

Therefore, beam-forming systems have been developed that provide surround sound fields from encoded or discrete sources that are not only widening systems, but form beams that can direct the sound toward walls and away from the listener, thus providing the surround channel information as reflections. Such systems typically use a large horizontally distributed array of speakers in order to form separate beams for the surround channel sources that direct the surround channel sound away from the listener toward the walls so that the surround channel sounds arrive later and from a different angle. However, such arrays are costly, as separate drivers must be provided for each element in the array. Further, tuning of such an array system can be complicated by the lack of unobstructed paths to the reflection zones at the walls of the room. U.S. published Patent Application 20040151325A1 describes such a large horizontal array beam-forming system and U.S. published Patent Application 20050041530A1 describes a two-dimensional array system that provides a beam focused in both horizontal and vertical planes.

When using such an array system with a DTV unit or any audio device that includes internal speakers and/or amplifiers, the speakers in the device are typically disabled by the user (or the amplifiers are unused), as the regular stereo image produced from the internal speakers will interfere with the surround field provided by the array. Since the amplifiers and/or speakers add cost to the device, it would be desirable to use them in some manner, especially if the cost of components used to generate a surround field could be reduced.

Therefore, it would be desirable to use internal speakers of a DTV or other device to surround-sound beam-form with external speakers. It would further be desirable to provide a device that incorporates a surround-field producing speaker system entirely within the device. It would also be desirable to provide a beam-forming surround sound system that does not require an array with a large number of elements and further reduces the difficulty in providing an unobstructed path for the beam(s).

SUMMARY OF THE INVENTION

The above stated objectives of providing a device in which internal speakers are used without requiring an array with a large number of elements to form a surround field is satisfied in a method and system. The method is a method of operation of the system or a device incorporating the elements of the system.

The system uses at least one internal speaker of a device that provides an audio program or audio portion of an A/V program as part of a surround beam-forming system. The internal speaker(s) is used in phase-aligned conjunction with a corresponding external speaker or speakers to generate a beam.

The beam may be a surround-channel beam directed away from a listening position so that the surround channel is heard substantially only as reflections in the listening room. The beam may be directed above the listener, or to the right or left. Alternatively, the beam may be a "night-mode" beam for concentrating sound only in one listening position, or multiple beams may be formed for picture-in-picture or other applications where separate audio content is concentrated at two or more listening positions.

The above-described objectives, features, and further advantages of the invention are described in more detail below, in conjunction with the accompanying drawings, in which like reference numerals indicate like elements.

BRIEF DESCRIPTION OF THE DRAWINGS

Details of the invention and the uses thereof will be understood by a person of skill in the art when reading the following description in conjunction with the accompanying drawings. Further objectives and advantages presented by the invention will be apparent in light of the following description and drawings, wherein like reference numerals indicate like components, and.

DESCRIPTION OF ILLUSTRATIVE EMBODIMENT

The present invention encompasses systems and methods that include an internal speaker of an audio-reproducing device in a beam-forming process. The device may be a video device having speakers included for the rendering of audio content, such as a DTV or computer monitor, or may be an audio-only device, such as a stereo system having internal speakers. Additional external speakers are connected to the device, which includes an internal processing circuit that provides one or more outputs that form a beam for reflection of audio surround information from surfaces of a room. In a surround simulation mode, the surround channel signal(s) are provided via beam-forming that produces reflections via one or more beams directed away from the listener. The beam(s) are formed by a phase-aligned combination of an internal and an external speaker. The main channel audio information is presented via the external or internal speaker or a combination thereof. Special beam-forming modes provide an isolated listening location for night-time viewing ("Night Mode") or multiple isolated and channelized beams for simultaneous viewing of split-screen or picture-in-picture (PIP) program selection in two or more listening locations.

Figure 1A:
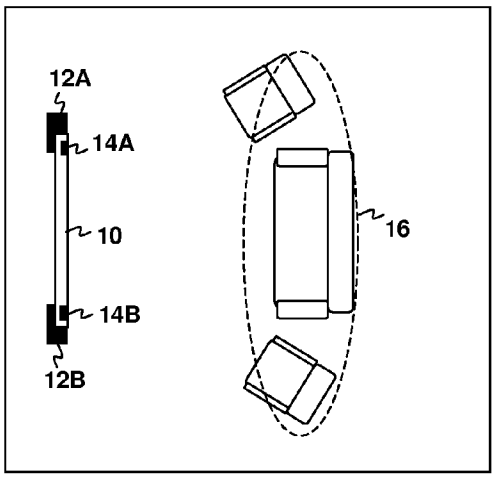
FIGS. 1A-1D are views of a room incorporating a DTV surround-sound system in accordance with an embodiment of the present invention.
Figure 1B:
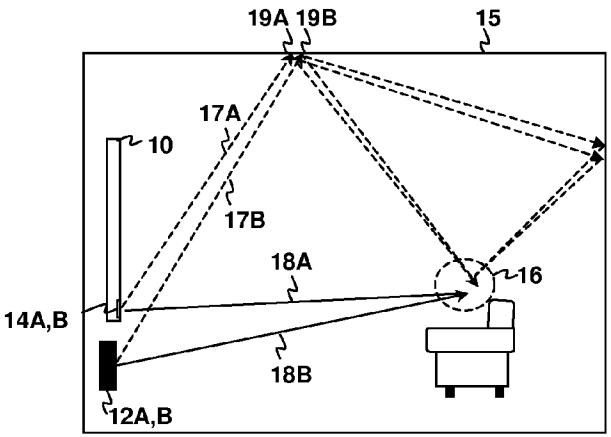

Referring now to the Figures, and in particular to FIGS. 1A and 1B, operation of a system of the present invention is illustrated. The illustrated system is a DTV 10 that includes an internal set of stereo speakers 14A-B and a set of external speakers 12A-B having inputs coupled to DTV 10 for operating external speakers 12A-B in phase-alignment with internal speakers 14A-B. The term "phase-alignment" is understood to define a particular phase relationship between the speakers and not necessarily a zero-time aligned relationship with respect to each channel and speaker. In fact, it is the difference between the time-alignment for surround channels versus main channels that provides the directionality used in the present invention to present diffuse surround channel information and direct main channel information from speakers located substantially near a single wall of a room.

In contrast to typical horizontal surround beam-forming arrangements, the DTV of the present invention uses the vertical offset of speakers within speaker pairs 12A,14A and 12B,14B to project a beam 17A, 17B to reflection points 19A, 19B, which follow a path to a listening area 16 as shown that is longer than the distance traveled along a direct path 18A, 18B to the listener via reflection from the ceiling and also the rear wall. While lines are used to illustrate beam directions in the Figures, in actuality the lines represent only the direction of maximum intensity and in actuality the directivity pattern of interference between speakers 12A,14A and similarly 12B,14B will dictate the spread of acoustic energy along ceiling 15 that provides a diffuse reflected beam that is provided with surround-channel information. The right and left surround channel beams can be directed upward and toward their respective directions, striking the wall and ceiling in either order, to provide some directional relationship from right to left in the surround channel information.

The system is calibrated so that the main channel (front speaker) information is maximized according to the vector sum of direct paths 18A,18B such that the main speaker information is provided in-phase at listening position 16, while the surround channel (rear speaker) information is nulled by the vector sum of direct paths 18A,18B, so that a listener at listening position 16 will hear the surround channel information only as reflected energy from ceiling 15 and room walls. Since each pair of speakers 12A,14A and 12B, 14B provides a two-lobed pattern, another maximum intensity beam is directed toward the floor of the room. However, the floor in a home environment is typically carpeted, which attenuates the higher frequencies involved in the surround channel beam. Further, the system will generally be calibrated to suppress the reflection from the floor, which is also more subject to obstruction, even if the floor is sound-absorbent. Also, in the configuration shown, the floor path to the listener would be shorter, and thus provide less apparent distance. In general, it is desirable to spread external speakers 12A-B slightly wider than the internal speaker spacing, which is generally limited to around 50 inches. The wider spread provides not only generally better main channel stereo imaging, but the horizontal displacement aids in flexibility with respect to beam-forming calibration, particularly in PIP and Night Modes. Also, if DTV 10 is mounted on a wall, it is generally desirable to mount external speakers 12A-B slightly below DTV 10 or in general, at approximately mid-height with respect to the total height of the wall.

The surround beam-forming implemented in the system of the present invention generally uses a limited band of frequencies that is above the low-frequency range where beam-forming is not necessary due to the non-directive perception of low frequency acoustic energy and also not practical due to the spacing required in the beam-forming array. Energy below approximately 250 Hz is generally provided only in the direct channel, which is either a substantially in-phase signal provided to internal speakers 14A-B and external speakers 12A-B, or the low-frequency information may be provided only to external speakers 12A-B. The low-frequency cut-off frequency can be set in conformity with a typical speaker spacing such that no beam is formed for the common (in-phase) low frequency information. However, the practical low-frequency cut-off can be "learned" during the calibration process described below and the cut-off frequency adjusted in conformity with the calibration measurement results. Additionally, the system can determine whether it is practical to use the internal speakers 14A-B for low frequency operation. If poor low-frequency response is detected with respect to internal speakers 14A-B, they can be selectively disabled.

In general, there is a trade-off between the lowest and highest practical beam-forming frequencies that is determined by the speaker spacing. The high-frequency cutoff for the beam-forming is also set in conformity with the speaker spacing such that combing effects are minimized. In general, practical high-end cutoff frequency for external speakers used in conjunction with internal speakers will be around 2500 Hz, due to the spacing between the internal and external speakers. However, the practical high-frequency cut-off can be "learned" during the calibration process described below and the cut-off frequency adjusted in conformity with the calibration measurement results. Since external speakers 12A-B are generally supplied by or may be replaced by the system owner, external speakers 12A-B can be provided with whatever level of low-frequency performance and amplification the consumer desires. The speakers employed in DTV devices, which must fit the package dimensions and cost point for the DTV components, will generally have poorer low-frequency performance than even a low-cost set of external bookshelf speakers. Additionally, less amplifier power is required for the higher-frequency audio bands and therefore the amplifiers provided in DTV 10 can be much smaller and dissipate less heat if only the higher-frequency components of the main and surround channel signals are provided to internal speakers 14A-14B.

The beam-forming channel is also generally band-limited to remove higher frequencies, for example, those above approximately 2500 Hz, for which the spacing between speaker pairs 12A,14A and 12B,14B usually extends to multiple wavelengths, and therefore would generate a "combing" effect that would be difficult to remove with calibration. For this purpose, the high-frequency information may be provided to internal speakers 14A-B and removed from the signals provided to external speakers 12A-B. Internal speakers 14A-B are generally provided with signals directly from amplifiers internal to DTV 10. The high-frequency information can be processed via delays or filtering to provide a simulated surround effect from a single speaker used as a tweeter. External speakers 12A-B will generally be powered speakers that receive either a corresponding line-level analog output signal from DTV 10 or a digital signal such as an optical or coaxial SONY/PHILIPS Digital Interface (S/P-DIF) connection. However, additional amplifiers may be included within DTV 10 that can provide power signals to external "non-powered" speakers.

Figure 1C:
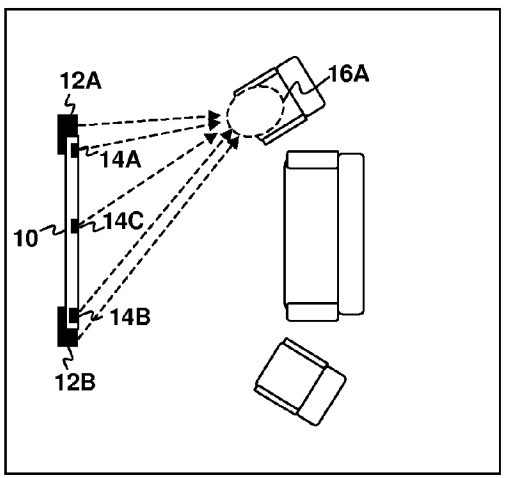
Figure 1D:
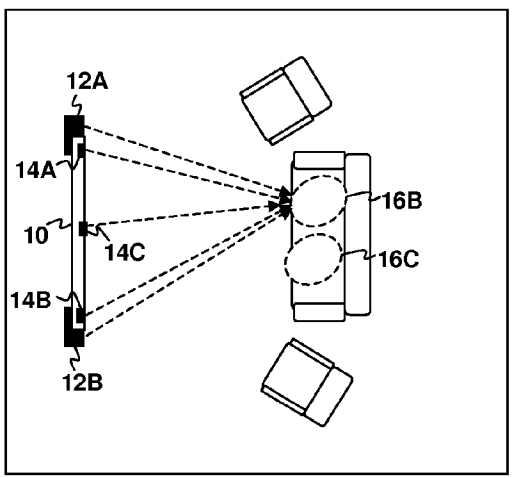

Additional non-surround beam-forming modes are also provided by the system of FIGS. 1A and 1B. In a "Night Mode", as illustrated in FIG. 1C, the system can be calibrated to neutralize sound in all zones apart from a particular limited listening area 16A and in "Picture-in-Picture (PIP) Mode", for use with split screen viewing or PIP screen presentation of video, two listening areas 16B and 16C can be provided as illustrated by FIG. 1D, where the goal is not to neutralize sound outside the listening areas 16B and 16C, but to maximize isolation between the two zones, which is generally accomplished by using the right and left stereo channels for the separate audio information, but calibrating the system to neutralize sound for the non-corresponding channel within each of listening areas 16B and 16C. Horizontal beam formation is required for both modes described above, and in particular, the PIP mode can be accomplished somewhat using the horizontal displacement between the right and left pairs of speakers 12A,14A and 12B,14B and directing nulls with respect to the undesired program channel at each listening position.

However, to achieve a pattern that has a beam at only one position, in particular for Night Mode, more horizontal distribution of control is required. The horizontal distribution can be accomplished by some displacement between internal speakers 14A-14B and the corresponding external speakers 12A-12B, as well as the displacement between the right and left pairs. If a center channel speaker 14C is provided either in DTV 10 or external to DTV 10, center channel speaker 14C will aid in the horizontal pattern control employed in Night Mode and PIP mode. Further, additional horizontally displaced speaker pairs may be added to the system and provided with their own adjustable signal paths.

Figure 2:
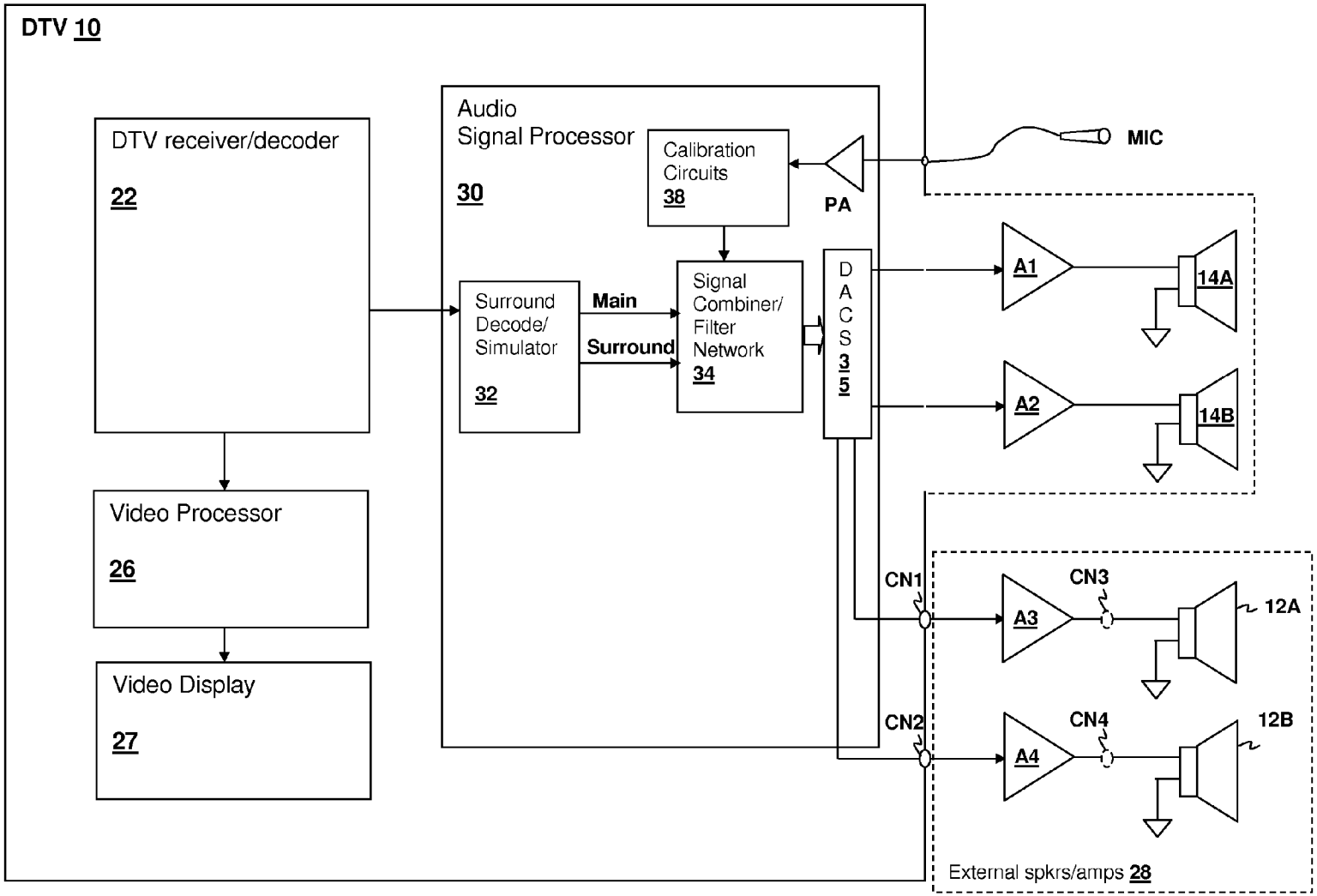
FIG. 2 is a block diagram of the system of FIGS. 1A-1D.

Referring now to FIG. 2, a block diagram of circuits within the system of FIG. 1 is shown. DTV 10 includes a DTV receiver/decoder 22 that receives digital and/or analog television signals from a cable television (CATV), digital versatile disc (DVD) player, videocassette recorder (VCR), antenna or other form of signal connection (not shown) and provides video information to a video processor 26 that supplies graphical information to a video display 27. Video processor 26 supports such features as picture-in-picture (PIP) and split-screen modes that are relevant to some of the surround audio beam-forming modes described in detail below. DTV receiver/decoder 22 also provides audio information to an audio signal processor 30 that includes a surround decode/simulator circuit 32, calibration circuits 38 that receive a signal from an external microphone MIC via a preamplifier PA, and a signal combiner/filter network 34. Microphone MIC is ideally an omni-directional microphone, so that all responses with respect to a given speaker or combination of speakers is detected during calibration. The outputs of signal combiner/filter network 34 are provided to DACs 35 that generate analog output signals for internal speakers 14A-B via corresponding power amplifiers A1 and A2, and also to external connectors CN1 and CN2 that supply line-level signals to amplifiers A3 and A4, which in turn supply power signals to a set 28 of external speakers 12A-12B. DACs 35 and amplifiers A1-A2 may be replaced with pulse-width modulator/filter circuits. Alternatively, connectors CN3 and CN4 may be provided if amplifiers A3 and A4 (or PWM output drives/filters) are incorporated within DTV 10.

Surround decode/simulator circuit 32, decodes any encoded main channel, surround channel and other surround-sound information in the audio stream(s) provided from DTV receiver/decoder and may optionally synthesize surround channel information if such surround-sound information is absent from the audio streams(s). Signal combiner/filter network 34 takes the main and surround channel information for each stereo side and generates the proper signals via digital-to-analog converters (DACs) 35 to amplifiers A1-4 to form the direct beam for the main channel information and the reflected beam for the surround channel information. Calibration circuits 38 tune filters within signal combiner/filter network 34 during a calibration set-up process in order to minimize reflected energy at listening position 16 for the main channel information and to maximize the delay of the reflected energy for the surround channel information, when in surround mode. In the other operating modes, the calibration circuits 38 provide other pattern control tuning consistent with those modes as described in further detail below.

Figure 3B:
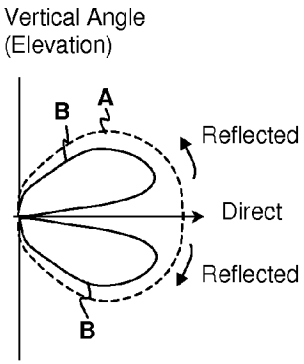
FIG. 3B is a graph showing sound pressure level directivity patterns produced by the speaker arrangement of FIG. 3A in surround mode.
Figure 3D:
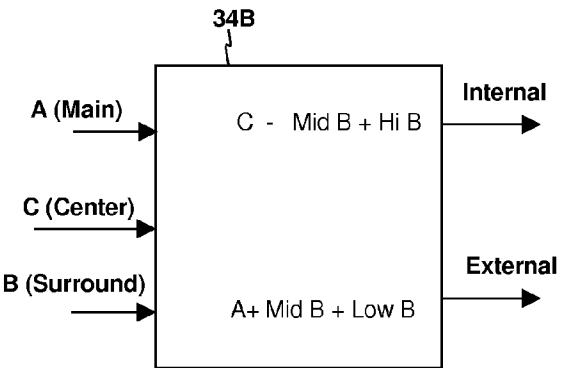
FIG. 3D is an illustration showing an alternative signal combiner 34B that can be employed in the speaker arrangement of FIG. 3A.
Figure 3A:
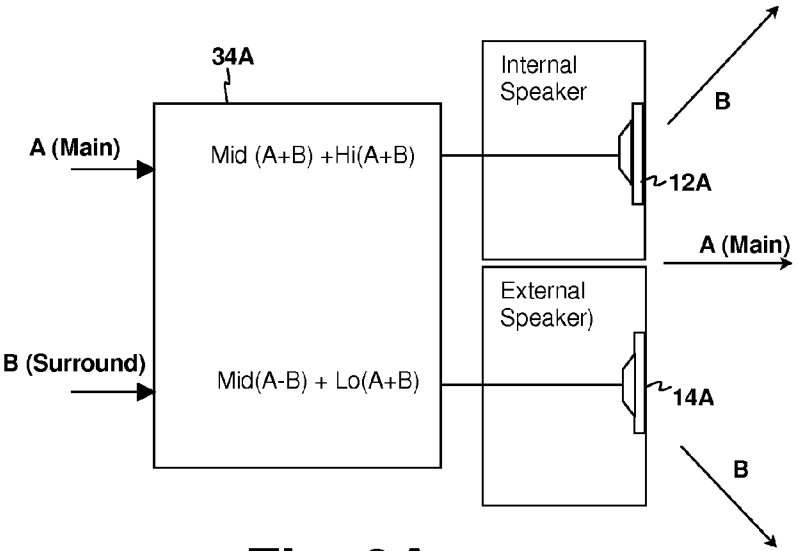
FIG. 3A is an illustration showing a speaker arrangement that can be employed in the system of FIGS. 1 and 2.

Referring now to FIG. 3A, an illustration showing a speaker arrangement that may be employed in the system of FIGS. 1 and 2 is depicted in accordance with an embodiment of the present invention. In the depicted embodiment, internal speaker 12A is used at higher frequencies and the beam-forming midrange frequencies and external speaker 14A is used at lower frequencies and the beam-forming midrange frequencies. Therefore, both speakers are active in the midrange beam-forming frequency range. With an internal/external speaker configuration, both speakers will typically have a full-range response, but that is not a requirement to practice the invention. A simplified combiner 34A is shown for illustrative purposes that receives a main channel signal A and a surround channel signal B. The signal provided to internal speaker 12A is A+B for both the midrange (overlap range) and the high frequency range, and the signal provided to external speaker 14A is A−B for the midrange and A+B for the low-frequency range.

The result of the operation of combiner 34A is that the midrange of the surround channel signal B is provided out-of-phase (as between speakers 12A and 14A) along the direct path to a listener located on-axis between speakers 12A and 14A, thus producing a null with respect to the midrange surround channel information toward the listener. Thus, the listener will not hear the surround channel information as emanating from speakers 12A and 14A, but will rather hear the surround channel information as diffuse, coming from a range of reflection points primarily along the ceiling. The main channel midrange information is provided in-phase (as between speakers 12A and 14A) along the direct path, so that the main channel information is heard as emanating from the speakers. In the low-frequency range and also for the high-frequency range, the main and surround channel information are combined and are only supplied to one speaker of each vertically-displaced speaker pair, so that no beam-forming is produced in those frequency ranges.

Referring now to FIG. 3B, a directivity pattern of the speaker arrangement of FIG. 3A is shown for the midrange beam-forming range. Signal A is shown as having a substantially cardioid shape, while signal B is produced in two lobes, one directed at the ceiling and one directed at the floor, due to the vertical displacement of speakers 12A and 14A.

Figure 3C:
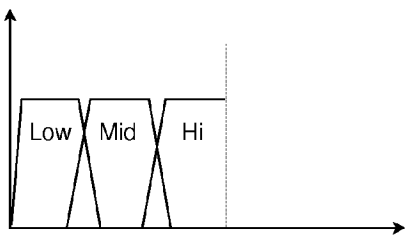
FIG. 3C is a graph illustrating a frequency response of speaker driver channels within the system of FIGS. 1 and 2.

FIG. 3C illustrates the three band filtering scheme of combiner 34A in which beam-forming is employed in the midrange frequency band Mid. In the Low frequency band, the sum of the main and surround channel information can be sent to both speakers, since the longer wavelengths will ensure that the drivers act in phase. Alternatively, the Low band might be provided only to external speakers selectively, in response to the results of a calibration or user setting, or as a fixed design feature under the assumption that the external speakers 12A-B will have superior low frequency response. In the High frequency band, generally only one of the full-range speakers will be used so that "combing" effects do not occur due to interference between the speakers.

FIG. 3D depicts an alternative combiner 34B, that may be an operating mode selected in alteration with signal combiner 34A and other modes. In combiner 34B, a center channel signal C is provided to only the internal speakers 12A, 12B and in phase to both right and left internal speaker 12A, 12B. The main channel signals A are applied only to the corresponding right or left external speaker 14A, 14B. For surround channel signals B, at least the midrange beam-forming frequencies are applied in-phase to corresponding right or left external speakers 14A, 14B and out of phase to internal speakers 12A, 12B. The low frequency portion of surround channel signals B can be optionally applied to the corresponding right or left external speaker 14A, 14B, or not rendered at all. The high frequency portion of surround channel signals B can be provided to corresponding right or left internal speaker 12A, 12B. The result, for the use of high quality external speakers 14A, 14B is a higher quality rendering of the main channel A sound, e.g., for music programs. Center channel C sounds are typically speech and other sibilant-type sounds for which the internal speakers 12A, 12B provide suitable response and their generally closer horizontal spacing as well as the proximity to the video screen will yield an improvement in apparent location of center channel sounds.

Figure 4A:
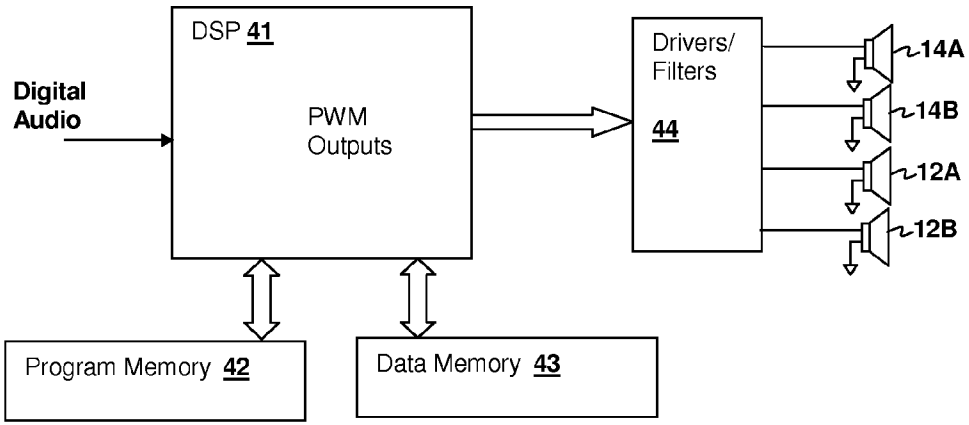
FIG. 4A is a block diagram of a system in accordance with another embodiment of the present invention.

Referring now to FIG. 4A, a system in accordance with an embodiment of the present invention is shown. The depicted system employs a digital signal processor (DSP) 41 that performs the signal combining/filtering functions, as well as frequency-band splitting and any compression/protection algorithms used in the system. DSP 41 is coupled to a program memory 42 containing program instructions forming a computer program product in accordance with an embodiment of the present invention, and further coupled to a data memory 43 for storing data used by the computer program and results produced thereby. The outputs of DSP 41 are depicted as pulse-width modulator (PWM) outputs for each channel, with corresponding low-pass filters and driver transistors 44, generally half-bridge circuits with series LC filters connected to speakers 14A-14B and optionally (non-powered) speakers 12A-12B. The signal combining, filtering and compression functions performed by the algorithms of the computer program embodiment will be described in further detail below in illustrations that apply to discrete circuits as well as the algorithms executed by DSP 41.

In the "night mode" and split-screen or PIP modes described above, DSP 41 can also be used to detect the nature of the sounds provided by the audio channel(s) and operate the beam-forming algorithms accordingly. Detection of speech is performed by correlating the stereo signals provided for each channel, since most speech information is presented monophonically (i.e., equal and in-phase levels at each channel). The signals are also further analyzed to detect modulation patterns characteristically different for music and speech. DSP 41 then equalizes, compresses and re-processes the audio information provided by each direct beam to improve intelligibility of speech in each direct beam, while the other direct beam might have speech or music. For example, since unintelligible speech will generally detract completely from television viewing, while musical background or other presentation is generally far less critical, speech can be favored over music as shown in Table I below, which can be applied to PIP or split-screen modes. The surround beams can be provided with the wide portion of the stereo program (i.e., the uncorrelated information between right and left in each stereo signal source), without detracting much from either program's audio.

TABLE I

| Channel 1 | Channel 2 | Processing |
|---|---|---|
| Speech | Speech | Boost high frequencies moderately, equalize levels between channels, attenuate frequencies where beam-forming is ineffective |
| Speech | Music | Slightly attenuate music, especially reducing 500-2000 Hz region |
| Music | Music | Apply multi-band level equalization |

Calibration of beams in PIP or split-screen modes involves placement of the calibration microphone at each location for individual calibration, the provision of two or more directional microphones for simultaneous calibration, or an assumption that the performance of the listening environment will be symmetrical across a line dividing the two listening areas. The response of the direct beam with respect to the two program channels can be optimized by minimizing the ratio of the other program information to the program associated with the beam being measured. "Night Mode" performance can be optimized to reduce the amount of low frequency information, while retaining speech intelligibility and beam forming capability that restricts the space in which sound can be heard. For that purpose, high-frequency energy may also be attenuated in the ranges where combing can cause significant sidelobes to emerge. Calibration can be performed by placement of the microphone in the listening position and tuning the response of the individual horizontal and vertical array elements to form a narrow beam at the listening position. Alternatively or in combination, other positions at angles significantly apart from the listening position direction may be measured and the direct sound present at those positions minimized.

Figure 4B:
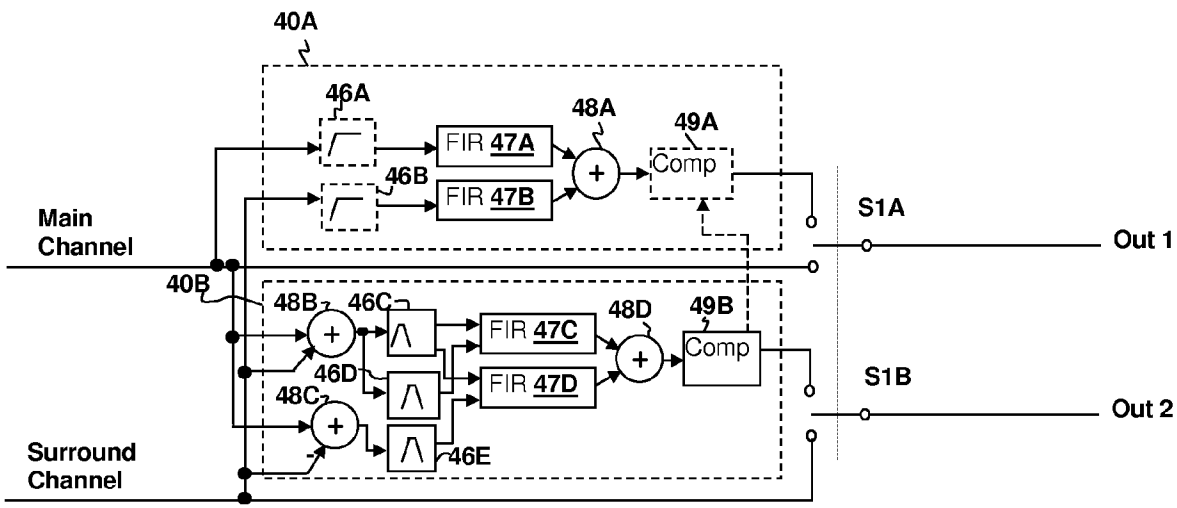
FIG. 4B is a block diagram of a direct and surround channel circuit in accordance with an embodiment of the present invention.

Referring now to FIG. 4B, a direct and surround channel circuit or algorithm in accordance with an embodiment of the present invention is shown in a block diagram. Only one stereo side (right or left) of the system is shown, as the other side will generally be an identical circuit. A Main Channel and Surround Channel signal are provided to processing blocks 40A and 40B, that provide respective output signals Out 1 and Out 2 to power driver stages that drive a pair of speakers. In a first position, switch portion S1A connects output signal Out 1 to the Main Channel signal and switch portion S1B connects output signal Out 2 to the Surround Channel signal, so that the system can be selectively used with placement of speakers at actual rear room positions. Alternatively, in a second position, switch portion S1A connects output signal Out 1 to the output of processing block 40A and switch portion S1B connects output signal Out 2 to the output of processing block 40B, so that the system provides beam-formed surround for use with placement of speakers at the front of the room as described above.

Processing blocks 40A and 40B are similar processing blocks, but processing block 40A removes low frequency information from output signal Out 1, which serves as a mid-high frequency output in a frequency selective configuration as described above. Similarly, processing block 40B removes high frequency information from output signal Out 2, serving as the mid-low frequency output.

Each of processing blocks 40A and 40B includes two adjustable finite impulse response (FIR) filters 47A-B and 47C-D, respectively, for calibrating the system maximum surround effect by adjusting the impulse response of each output Out1 and Out2 with respect to each input (Main and Surround Channels). In processing block 40A, an optional pair of high-pass filters 46A and 46B, remove low-frequency information from the Main and Surround Channel signals and a pair of adjustable FIR filters 47A and 47B provide for calibration of the beam-forming system. The outputs of FIR filters 47A and 47B are summed in-phase by a combiner 48A and then applied to an optional compressor 49A that protects a speaker coupled to output signal Out 1 from damage, or in general preserves overhead as the system works to beam-form over the mid frequency range. Also, in other modes such as Night Mode and PIP mode, compression and frequency-selective compression is applied by compressor 49A in order to reduce the audible volume required for intelligibility of speech and to limit the volume of program material such as music.

In processing block 40B, the Main and Surround Channel signals are summed in-phase by a combiner 48B and out-of-phase by a combiner 48C. The output of in-phase combiner 48B is low-pass filtered by filter 46C and provided to inputs of both of a pair of FIR filters 47C and 47D. The output of in-phase combiner 48B is also filtered by a bandpass filter 46D to provide a midrange output and provided to an input of FIR filter 47C. The output of out-of-phase combiner 48C output is also filtered by a bandpass filter 46E to provide a midrange output and provided to an input of FIR filter 47D. The outputs of FIR filters 47C and 47D are then combined and optionally compressed by compressor 49B, which may be linked to compressor 49A to prevent amplifier clipping as the speaker coupled to output signal Out 2 attempts to provide the correct level of midrange signals which may otherwise rise too high as overall system volume is increased. The resulting output of processing block 40B is a signal having the sum of the Main and Surround channel signals in a low-frequency band, and the difference between the Main and Surround channel signals in the midrange beam-forming band. Compressor 49B is also used in other modes such as Night Mode and PIP mode for the same reasons as described above with respect to compressor 49A.

The channel circuit of FIG. 4B is an example of an arrangement of blocks that implement an embodiment of the present invention or cascaded functions that can be applied in a DSP algorithm. However, alternative implementations are possible and in some instances preferred. For example, all of the filtering functions could be performed within FIR filter blocks, with the in-phase/out-of-phase midrange beam-forming summations performed also within the FIR filter blocks. Likewise speaker protection compression can be made part of the filter algorithm, as well. Therefore, a more generic expression of a channel circuit in accordance with an embodiment of the present invention can be made as a set of FIR filters each receiving either a Main or Surround channel signal and having output summed for forming output signals Out 1 and Out 2. Additional FIR filters for each discrete other speaker may be provided (e.g., center speaker or additional horizontally distributed speakers).

Figure 5B:
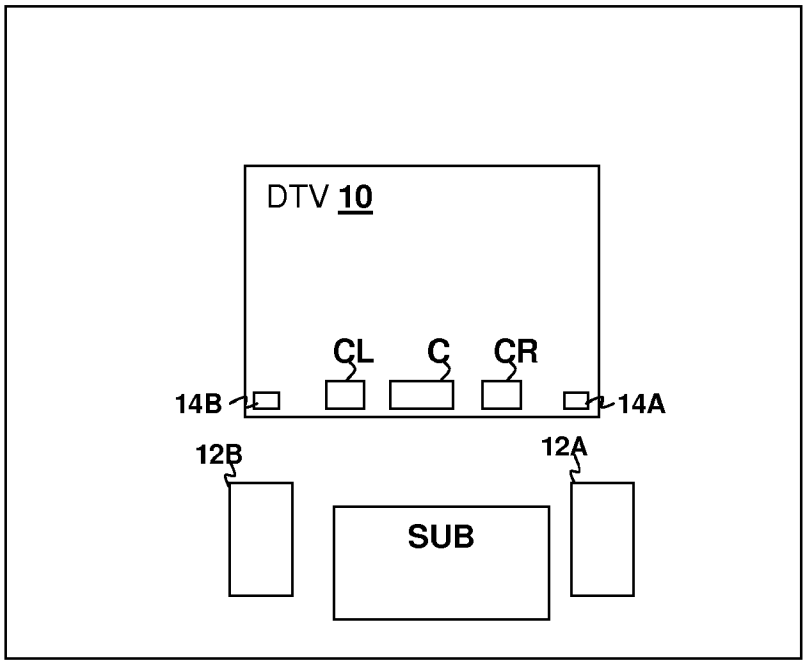
FIG. 5B is an illustration depicting a DTV speaker arrangement in accordance with another embodiment of the present invention.
Figure 5A:
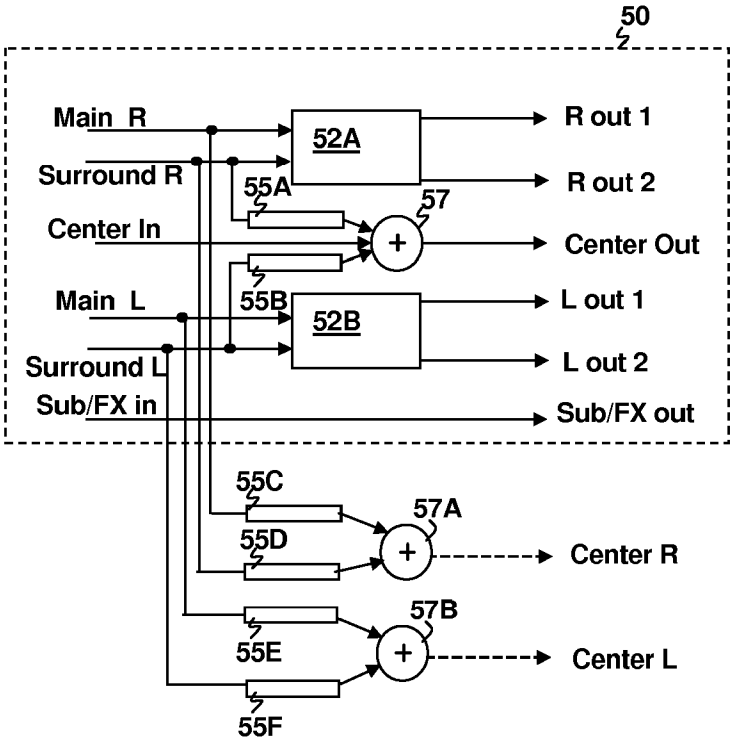
FIG. 5A is a block diagram of a system in accordance with yet another embodiment of the present invention.

FIG. 5A is a block diagram of a system in accordance with yet another embodiment of the present invention, having an expanded number of speaker output channels. Block 50 illustrates a 5.1 surround speaker configuration, adapted for use in a front-only speaker placement. Channel circuits 52A and 52B provide the right and left channel outputs for the respective pair of beam-forming speakers and can be implemented as described above with respect to FIG. 4B. An additional set of FIR filters 55A-B and a combiner 57 combines time-aligned surround channel signals for left and right channels with the center channel, permitting the center channel to form part of the overall beam-forming array. Optionally, for a 7.1 surround system, additional FIR filters 55C-55F and another pair of combiners 57A-B can be added to generate a Center Right and Center Left output signal for another pair of speakers forming part of the speaker array.

FIG. 5B illustrates one possible implementation of a 5.1 or 7.1 DTV system and a consequent speaker arrangement. DTV 10 further includes a center speaker C, along with a center left CL and center right CR speaker. The vertical beam-forming speaker array is provided as described above by internal speakers 14A-B in combination with external speakers 12A-B. A subwoofer/effects channel speaker SUB is located beneath DTV 10. The resultant combination increases the degrees of freedom possible in calibrating maximum surround channel effect via adjustment of the individual FIR filters in channel blocks 52A and 52B as well as additional filters 55A-55F of FIG. 5A. Further, the horizontal arrangement of additional speakers C, CL and CR greatly improves pattern control and isolation in Night Mode and PIP mode.

Figure 6:
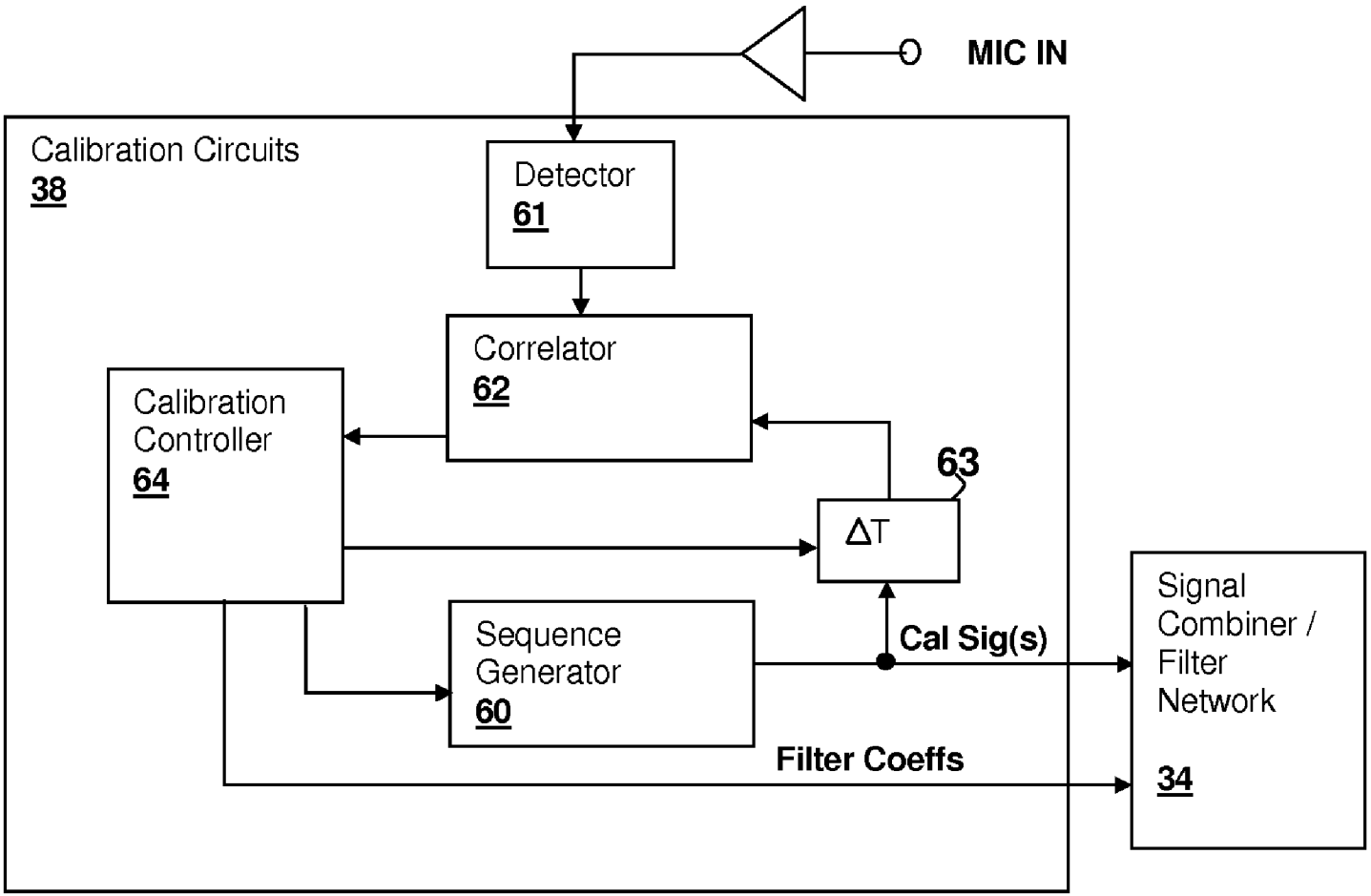
FIG. 6 is a block diagram of a calibration sub-system in accordance with an embodiment of the present invention.

Referring now to FIG. 6, a calibration sub-system in accordance with an embodiment of the present invention is illustrated in a block diagram. A calibration controller 64 in response to a user control of DTV 10 applies the output of a sequence generator 60 to signal combiner/filter network 34. Either one channel can be calibrated at a time, or multiple uncorrelated sequences can be provided to all channels for simultaneous calibration. An adjustable delay 63 applies the sequence signal(s) to a correlator (or multiple correlators) 62 that correlate the sequence(s) with a microphone signal provided from detector 61. The arrangement permits calibration controller 64 to determine the impulse response of each channel at the microphone position. With the microphone placed at the desired listening position, the system can then be calibrated via the adjustment of the filter coefficients within signal combiner/filter network 34 to minimize the reverberant (reflected) energy with respect to the main channel inputs and maximize the reverberation with respect to the surround channel inputs. While the illustrated calibration system uses a sequence such as a maximal-length sequence (MLS) to extract the impulse response of the system, frequency sweeping, chirping or white/pink noise techniques may be similarly employed, with correlator 62 replaced with an appropriate filter.

Figure 7:
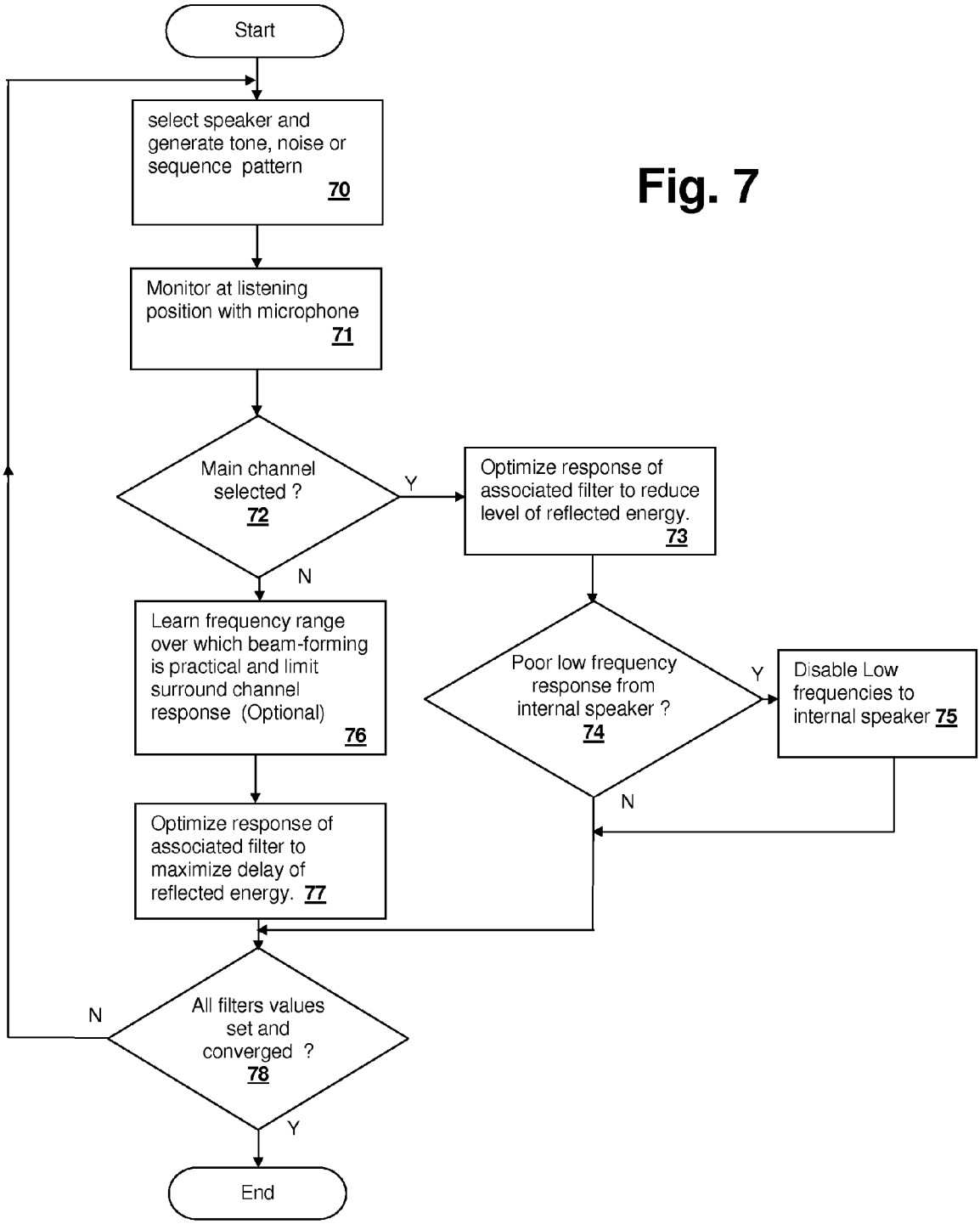
FIG. 7 is a flowchart depicting a surround mode calibration method in accordance with an embodiment of the present invention.

Referring now to FIG. 7, a flowchart depicting a calibration method in accordance with an embodiment of the present invention is shown. The illustrated method is for a single channel calibration on each pass, but the multi-channel simultaneous calibration follows the same pattern. First, an audio channel is selected and the tone, noise or sequence is generated through the corresponding channel (step 70). The listening position is monitored with a microphone (step 71) and if the channel under test is a main (direct) channel (decision 72), then the response of the channel filter is optimized to minimize the level of reflected energy (step 73). Optionally, if poor low frequency response is detected from the internal speaker (decision 74), then low frequencies can be disabled to that speaker (step 75). The above determination can be made via further selection of not only the channel in step 70, but selectively disabling the signal path to each speaker from the selected channel by disabling the FIR filter that couples the channel to the associated speaker channel.

If the channel under test is a surround channel (decision 72), the frequency range over which beam-forming is practical can optionally be learned and the surround channel response can be limited to that range (step 76). The frequency range over which beam-forming is practical can be determined by determining a low-end frequency at which the direct beam becomes difficult to suppress at the listening position due to loss in phase-cancellation between the internal and external speakers. Similarly, the high-end frequency at which the beam splits into additional beams due to combing can also be detected as a change in the ability to suppress the direct beam at the listening position. After optionally adjusting the surround channel frequency response in optional step 76, the response of the channel filter is optimized to maximize the delay of the reflected energy (step 77) to achieve the maximum reverberant effect. The process from steps 70-77 is repeated over each channel (or performed simultaneously) and also iterated until all filter sets have been calibrated and the values stabilized as between all of the channels (decision 78).

The above-described calibration can be performed by summing the response of the upper driver in each vertical pair with a time-delayed version of the lower driver response. As the delay is varied, a delay is reached having the greatest surround effect, which is determined as the above-described maximum of the ratio of late response to early response. The figure-of-merit is the ratio of late to early energy in the signal received at the microphone. A reasonable cut-off time for considering energy late vs. early for a typical room, is energy arriving more that 5 ms after the initial impulse response (direct energy) for a single speaker is considered late energy. The impulse response of the adjustable FIR filters in each channel can then be adjusted to accomplish the delay, which can be a frequency dependent delay for each channel. The direct response can also be calibrated in a similar manner, with the delay determined to minimize the reflected energy and maximize the direct (non-reflected) energy.

Figure 8A:
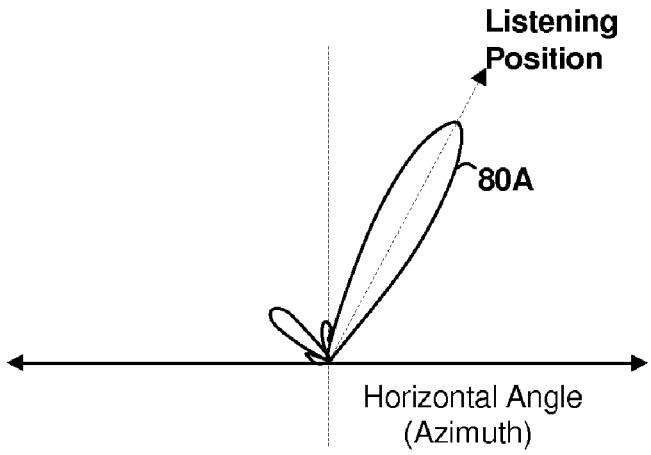
FIGS. 8A and 8B are a graph showing sound pressure level directivity patterns in night mode and picture-in-picture/split screen mode, respectively.
Figure 8B:
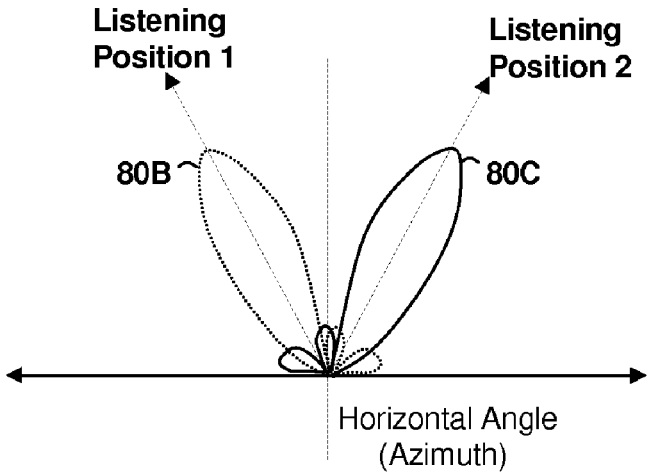

Referring now to FIG. 8A, a directivity graph of the system of the present invention in Night Mode is depicted. A single lobe 80A is formed by adjustment of each of the FIR filters that couple the input channels, which are summed together as a mono signal, to the speakers. FIG. 8B illustrates a directivity graph of the system in PIP or split-screen mode, where two distinct patterns are generated for two different input video program audio information channels. The audio information for each program is summed monophonically and then provided to the right and left main inputs of the above-depicted system. The system is calibrated to produce a lobe 80B or 80C with respect to each program channel. The system is calibrated to best minimize the energy from program 1 (i.e., the desired program in lobe 80B) at listening position 2 and vice-versa.

Figure 9:
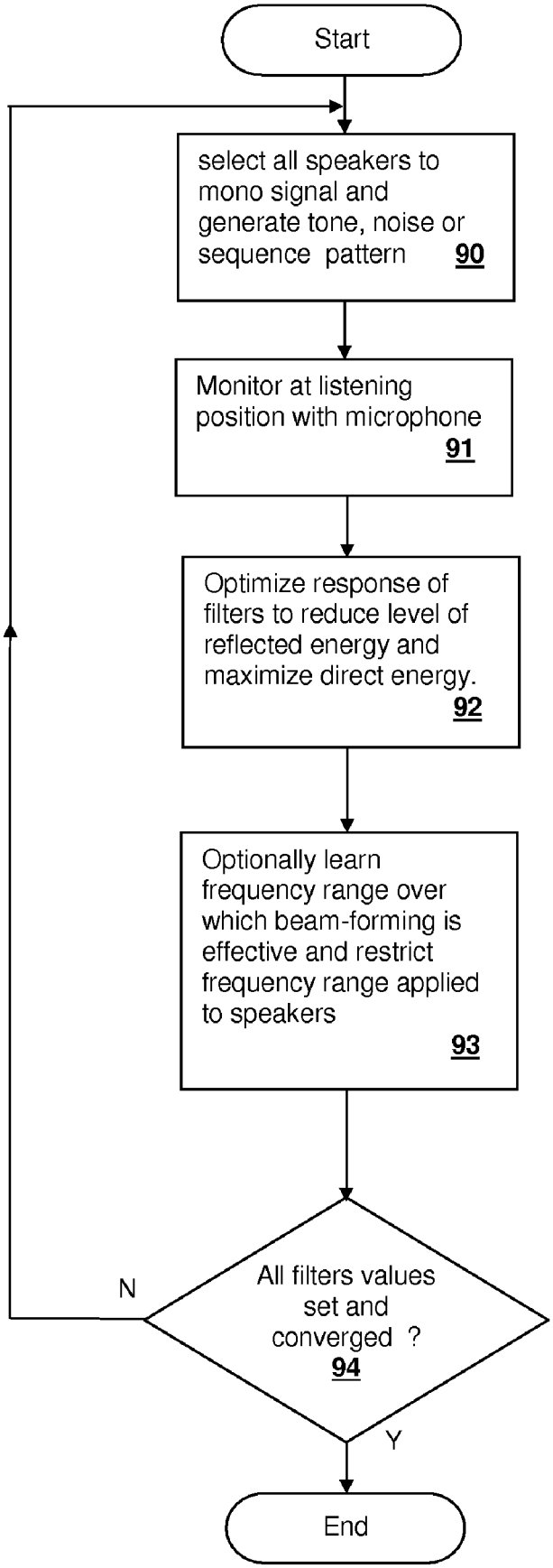
FIG. 9 is a flowchart depicting a night mode calibration method in accordance with an embodiment of the present invention.

Referring now to FIG. 9, a calibration method for Night Mode is depicted in a flowchart, in accordance with an embodiment of the present invention. First, all speakers are selected with respect to a summed audio signal and a tone, noise or sequence is generated through all channels (step 90). The listening position is monitored with a microphone (step 91), and the response of the channel filters is optimized to minimize the level of reverberant energy and to maximize the direct energy (step 92). Optionally, the frequency range over which beam-forming is practical can be learned, and the Night Mode response can be limited to that range (step 93). The frequency range over which beam-forming is practical can be determined by determining a low-end frequency at which the reflected energy becomes difficult to suppress at the listening position. The process from steps 90-93 is repeated over each channel (or performed simultaneously) and also iterated until all filter sets have been calibrated and the values stabilized as between all of the speaker channels (decision 94).

Figure 10:
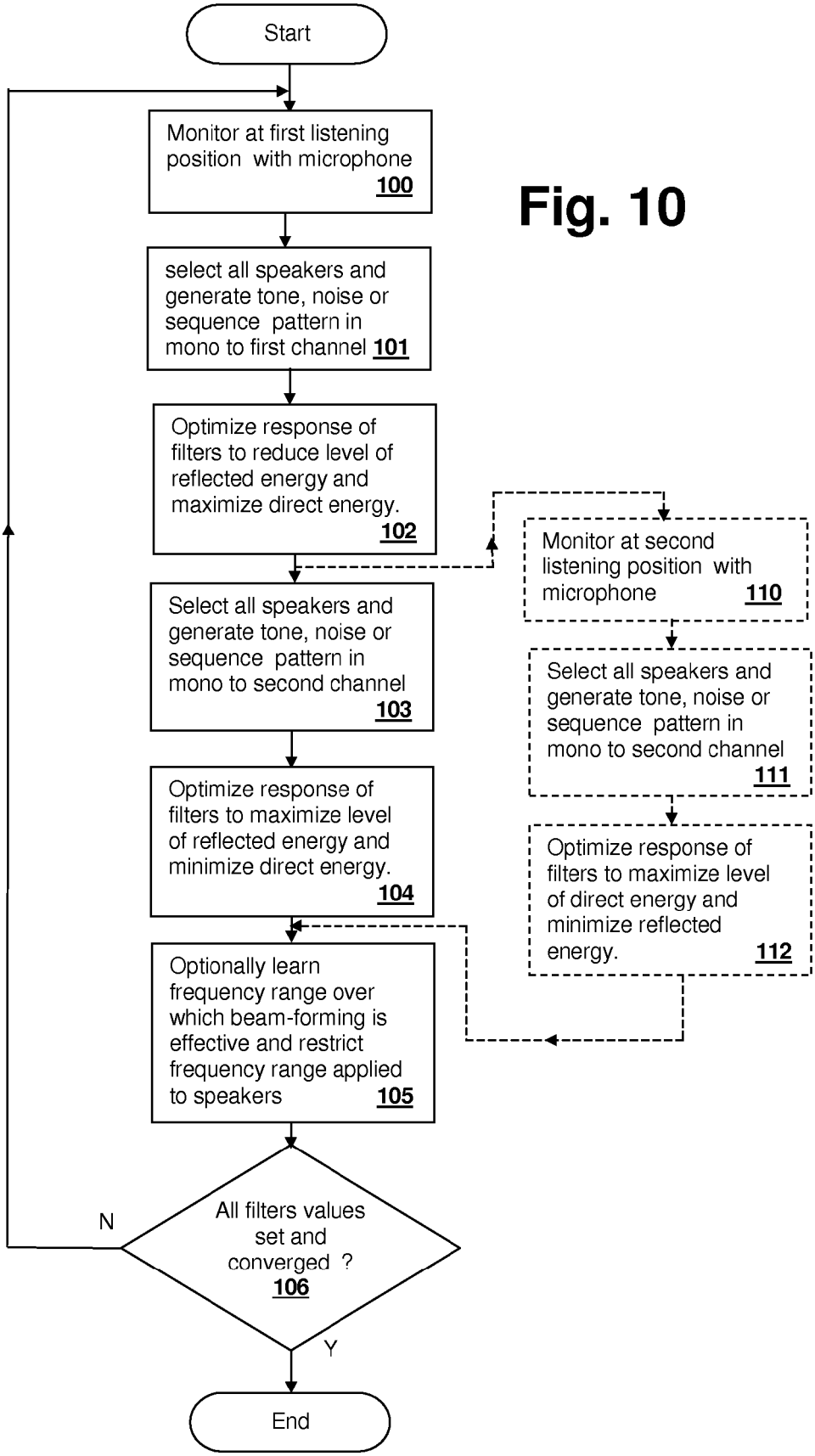
FIG. 10 is a flowchart depicting a picture-in-picture/split screen mode calibration method in accordance with another embodiment of the present invention.

Referring now to FIG. 10, a calibration method for PIP and split-screen Mode is depicted in a flowchart, in accordance with an embodiment of the present invention. The first listening position is monitored with a microphone (step 100). Then, all speakers are selected with respect to a summed audio first program channel and a tone, noise or sequence is generated through the first program channel (step 101). The response of the channel filters is optimized to minimize the level of reverberant energy and maximize the direct energy (step 102). Then, all speakers are selected with respect to a summed audio second program channel and a tone, noise or sequence is generated through the second program channel (step 103), and the response of the channel filter is optimized to maximize the level of reverberant energy and minimize the direct energy (step 104).

Alternatively, as shown in the dashed blocks, the second listening position may be monitored with a microphone (step 110), all speakers selected with respect to a summed audio second program channel and a tone, noise or sequence is generated through the second program channel (step 111) and the response of the channel filters optimized to minimize the level of reverberant energy and maximize the direct energy at the second listening position (step 112). The alternative technique provides improved information regarding the attenuation of first channel sound at the second listening position, but requires a second microphone or repositioning of a single microphone in order to accomplish the calibration.

After either of the alternative sub-methods depicted in steps 103-104 or steps 110-112 has been performed, the frequency range over which beam-forming is practical can be optionally learned and the PIP mode response can be limited to that range (step 105). The frequency range over which beam-forming is practical can be determined by determining a low-end frequency at which the reflected energy becomes difficult to suppress at the program-associated listening position or the direct energy becomes difficult to suppress at the alternate listening position. The process from steps 100-105 is repeated until all filter sets have been calibrated and the values stabilized as between all of the speaker channels (decision 106).

In summary, DTV 10 as described above, or another consumer audio device in accordance with an embodiment of the invention will include connections to support the number of external speakers employed in the beam-forming operation of the invention, which may be line-level outputs for powered speakers or power outputs for non-powered speakers. Any of the above beam-forming modes, such as Night Mode, PIP and surround mode may be included in any combination, and may be manually selectable via a switch mechanism or electronically selectable via an interactive screen menu or other remote technique, such as media computer control panels that cause reprogramming of DTV 10 characteristics and operating modes. Further, the outputs for external audio connections to speakers may be configurable as between a standard surround implementation via placement of the external speakers in actual rear locations in a room or simulated surround implementation with front-only or other placement of the external speakers, or the user can select between additional modes that provide the surround channel information only to the external or internal speakers. Finally, it will be understood that the system can operate without specification placement of the speakers, even in ideal surround speaker placement, by calibrating the system at whatever speaker positioning is implemented by the consumer.

The description provided above constitutes a description of the preferred embodiments of the invention, but the invention is not limited to the particular implementations shown or described. Those skilled in the art, having seen the above description and accompanying drawings, will understand that changes in form, structure and other details, as well as the order of operation of any operative steps may be varied without departing from the spirit and scope of the invention.

What is claimed is:

1. A consumer audio system having at least an audio playback capability, comprising:

at least one internal speaker located within a housing of a consumer audio playback device;

at least one first amplifier internal to said housing and having at least one corresponding output connected to said at least one internal speaker;

at least one audio connector accessible at an external surface of said housing for providing at least one signal to at least one external speaker; and an electronic network having at least one first output coupled to at least one input of said first amplifier and at least one second output coupled to said at least one audio connector, wherein said electronic network generates signals on said at least one first output and said at least one audio connector such that at least one beam is formed in a predetermined band of frequencies via phase alignment between each of said at least one internal speaker and a corresponding one of said at least one external speaker, wherein the phase alignment causes direction of sound resulting from combined sounds generated by the at least one internal speaker and the at least one external speaker away from a predetermined listening position.

2. The consumer audio system of claim 1, wherein said at least one internal speaker comprises a stereo pair of internal speakers integral to said housing, wherein said at least one first amplifier comprises a pair of amplifiers having corresponding outputs connected to terminals of said pair of internal speakers, wherein said at least one audio connector comprises a stereo pair of outputs for providing corresponding signals to at least two external speakers, and wherein said electronic network provides directional control in a predetermined band of frequencies via phase alignment between each of said internal speakers and a corresponding one of said at least two external speakers.

3. The consumer audio system of claim 1, wherein said at least one audio connector is a line-level output for connection to at least one external powered speaker.

4. The consumer audio system of claim 1, wherein said at least one audio output is a power output for connection to at least one external non-powered speaker and further comprising at least one second amplifier having an output connected to said at least one audio connector and an input coupled to said electronic network.

5. The consumer audio system of claim 1, further comprising a video display system integral to said housing, whereby said at least one internal speaker and said at least one external speaker supply an audio portion of a video program displayed by said system.

6. The consumer audio system of claim 5, further comprising a television receiver having a video output coupled to an input of said video display system and audio outputs coupled to an input of said electronic network, wherein said system is a television.

7. The consumer audio system of claim 1, wherein said electronic network includes a surround channel signal, and wherein said phase alignment provides a substantial null in response to said surround channel signal for a predetermined center front listening position with respect to said at least one internal speaker and said at least one external speaker.

8. The consumer audio system of claim 1, wherein said electronic network provides at least two non-associated primary audio program output signals, and wherein said phase alignment provides a first substantial null in response to a first one of said primary audio program output signals at a first predetermined listening position with respect to said at least one internal speaker and said at least one external speaker and a second substantial null in response to a second one of said primary program audio output signals at a second predetermined listening position with respect to said at least one internal speaker and said at least one external speaker.

9. The consumer audio system of claim 8, further comprising:

a video display system integral to said housing, whereby said internal and external audio transducers supply an audio portion of a video program displayed by said system; and a television receiver having first and second video output signals combined in an input of said video display system, wherein said first video output signal is displayed in a first view of said video display system and said second video output signal is displayed in a second view of said video display system, wherein said first primary program audio output signal is associated with said first view and said second primary program audio output signal is associated with said second view, whereby said system provides substantially isolated listening experience in two room locations for corresponding viewers of said first and second view.

10. The consumer audio system of claim 1, wherein said electronic network provides a single primary audio program output signal and wherein said phase alignment provides a narrow beam in response to said single primary audio program output signals at a first predetermined listening position with minimal audible program outside of said narrow beam.

11. The consumer audio system of claim 1, wherein said electronic network is frequency selective such that for a range of frequencies higher than said predetermined band of frequencies signals are only provided to said at least one first amplifier, and for a range of frequencies lower than said predetermined band of frequencies signals are provided in-phase to both of said at least one amplifier and said at least one audio connector, whereby combing is avoided in said range of frequencies higher than said predetermined band of frequencies and beam-forming is not attempted for frequencies lower than said predetermined band of frequencies.

12. The consumer audio system of claim 1, wherein said electronic network comprises:

a first filter for receiving a surround channel input and providing an output coupled to said at least one first amplifier; and a second filter for receiving said surround channel input and providing an output coupled to said at least one audio output, and wherein said phase alignment is provided by adjusting a phase response of said first filter and second filter to provide a pair of beam lobes having a null disposed therebetween and directed at a predetermined listening position.

13. The consumer audio system of claim 12, wherein said electronic network further comprises:

a third filter for receiving a main channel input and providing an output coupled to said at least one first amplifier; and a fourth filter for receiving said main channel input and providing an output coupled to said at least one audio output, and wherein said phase alignment is provided by adjusting a phase response of said first filter, second filter, third filter and fourth filter to provide a single beam directed at a predetermined listening position.

14. The consumer audio system of claim 12, wherein said phase response of said first filter and second filter are adjusted to minimize direct sound directed at said predetermined listening position in response to said surround channel signal.

15. The consumer audio system of claim 1, further comprising a microphone input for providing a calibration input and a calibration signal generator for providing an input to said electronic network during a calibration interval, and wherein said phase alignment between said at least one internal speaker and said at least one audio output is adjusted in conformity with a result of detecting said microphone input in response to completion of said calibration interval.

16. The consumer audio system of claim 1, wherein said electronic network operates according to a selectable mode, wherein in a first selectable mode, said at least one internal speaker is disabled, wherein in a second mode, said at least one internal speaker and said at least one external speaker operate to form said beam, wherein said beam is for directing surround channel information received by said electronic network away from a predetermined listening position, and wherein in a third mode, said surround channel information is provided only to said at least one external speaker.

17. The consumer audio system of claim 16, wherein in a fourth selectable mode, said at least one internal speaker and said at least one external speaker operate to form said beam, wherein said beam is for directing all audio information received by said electronic network toward a predetermined listening position.

18. The consumer audio system of claim 17, wherein said electronic network includes a compressor for managing a level of said audio information.

19. The consumer audio system of claim 16, wherein in a fourth selectable mode, said at least one internal speaker and said at least one external speaker operate to form a first and second beam, wherein said first beam is for directing first program audio information received by said electronic network from a first program input toward a first predetermined listening position, and wherein said second beam is for directing second program audio information received by said electronic network from a second program input toward a second predetermined listening position.

20. The consumer audio system of claim 19, wherein said electronic network includes a first compressor for managing a level of said first program audio information and a second compressor for managing a level of said second program audio information.

21. The consumer audio system of claim 1, further comprising at least one additional audio connector accessible at an external surface of said housing for providing at least one signal to at least one additional external speaker horizontally displaced from said at least one internal speaker and said at least one external speaker, and wherein said electronic network generates signals on said at least one first output, said at least one audio connector and said at least one additional audio connector such that at least one beam having a horizontally-directive characteristic is formed in a predetermined band of frequencies via phase alignment between each of said at least one internal speaker, a corresponding one of said at least one external speaker and a corresponding one of said at least one additional external speaker.

22. The consumer audio system of claim 1, further comprising at least one additional internal speaker horizontally displaced from said at least one internal speaker, and wherein said electronic network generates signals on said at least one first output, said at least one audio connector and said at least one additional audio connector such that at least one beam having a horizontally-directive characteristic is formed in a predetermined band of frequencies via phase alignment between each of said at least one internal speaker, a corresponding one of said at least one external speaker and a corresponding one of said at least one additional internal speaker.

23. A method of providing a beam from a consumer audio playback device, comprising: providing first signals to an internal speaker of said consumer audio device; and providing second signals for operating at least one other speaker, such that a beam is formed via a frequency dependent phase-alignment between said internal speaker and said at least one other speaker, wherein the phase alignment causes direction of sound resulting from combined sounds generated by the at least one internal speaker and the at least one external speaker away from a predetermined listening position.

24. A digital television, comprising:

a housing;

an audio-video decoder circuit for decoding received audio-video signals;

a video display coupled to said audio-video decoder circuit for displaying video program information;

a pair of internal speakers located within said housing;

a first pair of amplifiers having corresponding outputs connected to terminals of said pair of internal speakers;

a pair of connections for providing a pair of signals to a corresponding pair of external speakers; and an electronic network having a first pair of outputs coupled to corresponding inputs of said first pair of amplifiers and a second pair of outputs coupled corresponding ones of said pair of connections, wherein said electronic network generates signals on said first pair of outputs and said second pair of outputs such that directional control is provided in a predetermined band of frequencies via phase alignment between each of said internal speakers and a corresponding one of said pair of external speakers, wherein the phase alignment causes direction of sound resulting from combined sounds generated by the at least one internal speaker and the at least one external speaker away from a predetermined listening position.

* * * * *